US007895877B1

(12) United States Patent
Moreland

(10) Patent No.: US 7,895,877 B1
(45) Date of Patent: Mar. 1, 2011

(54) GUN BARREL STAMPER

(76) Inventor: Carl E. Moreland, Stilwell, OK (US)

( * ) Notice: Subject to any disclaimer, the term of this patent is extended or adjusted under 35 U.S.C. 154(b) by 51 days.

(21) Appl. No.: 12/421,889

(22) Filed: Apr. 10, 2009

Related U.S. Application Data

(60) Provisional application No. 61/125,682, filed on Apr. 28, 2008.

(51) Int. Cl.
*B21J 9/18* (2006.01)

(52) U.S. Cl. ..... 72/454; 72/295

(58) Field of Classification Search ..... 72/470, 72/412, 414, 454, 455, 457, 481.3, 481.6, 72/72, 29, 100, 295; 101/3.1–32
See application file for complete search history.

(56) References Cited

U.S. PATENT DOCUMENTS

| | | | | | |
|---|---|---|---|---|---|
| 795,300 | A | * | 7/1905 | Henry | 72/31.03 |
| 2,317,861 | A | * | 4/1943 | Speicher et al. | 101/28 |
| 2,389,206 | A | * | 11/1945 | Banta et al. | 72/31.03 |
| 3,177,688 | A | | 4/1965 | Kralowetz | |
| 3,537,337 | A | | 11/1970 | Best | |
| 3,889,984 | A | * | 6/1975 | Lambiris | 285/27 |
| 4,061,006 | A | * | 12/1977 | Burns, Jr. | 72/31.03 |
| 4,275,652 | A | | 6/1981 | Bo | |
| 4,422,783 | A | * | 12/1983 | Houk | 101/4 |
| 4,499,769 | A | * | 2/1985 | Conway | 73/587 |
| 4,599,942 | A | | 7/1986 | Bo | |
| 5,299,896 | A | | 4/1994 | Ferri | |

OTHER PUBLICATIONS

Brownells website page for Steel Stamp Guide—Mfg. B Square (www.brownells.com/aspx/NS/store/ProductDetail.aspx?p=1772 &title=STEEL%20ST).
Brownells website page for Steel Stamp Guide—Mfg. LA Bounty (www.brownells.com/aspx/NS/store/ProductDetail.aspx?p=26535 &title=STEEL%20S).

* cited by examiner

*Primary Examiner*—Dana Ross
*Assistant Examiner*—Pradeep C Battula
(74) *Attorney, Agent, or Firm*—Gable Gotwals

(57) ABSTRACT

A gun barrel stamping tool includes a die ram having a first U-shaped gun barrel fastener, a die container having a second U-shaped gun barrel fastener, and at least one die ram to die container fastener. The die ram and the die container each include opposing longer sidewalls and an elongate aperture located medially within each longer sidewall, the fastener being received by the elongate aperture. The die ram and die container combine to form an interior space for receiving a punch die. A circular aperture located medially within the shorter sidewall of the die container receives a punch die fastener for securing the punch die against the end wall of the die ram. The die container may include an adjustment mechanism for widening the interior space of the die container. The U-shaped gun barrel fasteners are located on opposing ends of the die ram and die container.

11 Claims, 6 Drawing Sheets

GUN BARREL STAMPER

CROSS-REFERENCE TO PENDING APPLICATIONS

This application claims the benefit of U.S. Provisional Application Ser. No. 61/125,682, filed on Apr. 28, 2008.

BACKGROUND

This version of the invention is concerned with the field of firearms accessories. More specifically, this version of the invention is concerned with gun barrel stamper for impressing upon a gun barrel a series of identifying alphanumeric characters in an even sequence and straight line.

PRIOR ART

Creating identifying marks, such as alpha-numeric characters, on the surface of a gun barrel involves the use of metal punch dies and a means to exert force or pressure against each individual punch die so as to impress the individual alpha-numeric character located at one end of each punch die upon the exterior surface of gun barrel. In many cases, a series of several alpha-numeric characters must be impressed upon the exterior surface of the gun barrel in order to create a usable identifying mark, serial number, or the like. For such alpha-numeric characters to be effective as an identifying mark, they must be impressed upon or otherwise crated on the exterior surface of the gun barrel in an even sequence and straight line so as to prevent any misreading or misunderstanding of the various alpha-numeric characters that comprise the identifying mark.

However, it is exceedingly difficult or impossible to create an identifying mark upon the exterior surface of a gun barrel in such a manner using conventional methods and devices. For instance, a common method involves placing a gun barrel in a holding device, such as a vice, and banging individual punch dies with a hammer or mallet against one end of the punch die to impress upon the gun barrel the individual alpha-numeric character located at the opposed end of the punch die. This process is not only laborious and time consuming but frequently ineffective as the punch die may slide off the exterior surface of the gun barrel when being struck by the hammer or mallet. In addition, the alpha-numeric characters that may be eventually transferred to the exterior surface of the gun barrel are usually done so in an uneven and haphazard manner, which makes reading or understanding the identifying mark difficult or impossible. Various punch die stamping devices and mechanisms are available in prior art and design. However, such devices are limited in the ability to create a series of alpha-numeric characters upon the exterior surface of a gun barrel.

The subject of the instant invention introduces a gun barrel stamper that overcomes the aforementioned disadvantages of previous methods and devices for stamping, impressing upon, or otherwise creating alpha-numeric characters upon the exterior surface of a gun barrel. The gun barrel stamper is comprised of a die container with interior space, a die ram inserted into the interior space of the die container, a series of punch dies located within said interior space of the die container, and fasteners for releasably attaching the gun barrel stamper to the exterior surface of a gun barrel and urging the punch dies located within the die container against the exterior surface of a gun barrel so as to impress upon the exterior surface of the gun barrel a series of alpha-numeric characters in an even sequence and straight line.

DISCUSSION OF THE PRIOR ART

The existence of a stamping device designed to create in an even sequence and straight line a sequence of alpha-numeric characters upon the exterior surface of a gun barrel is unknown at the present time. For example, numerous designs for stamping devices and tools for use with firearms and gun jigs have been provided in the prior art. Even though these designs may be suitable for the specific individual purposes to which they address, they would not be suitable for the purposes of the present version of the invention. These designs are exemplified by the following patents:

- U.S. Pat. No. 3,177,688, Forging Machine for the Internal Profiling of Tubular Workpieces, Particularly of Barrels for Firearms, issued to Kralowetz on 13 Apr. 1965;
- U.S. Pat. No. 3,537,337, Gun Jig, issued to Best on 3 Nov. 1970;
- U.S. Pat. No. 4,275,652, Marking Head for Cold Stamping Symbols on a Metallic Surface, issued to Bo on 30 Jun. 1981;
- U.S. Pat. No. 4,599,942, Cold Marking Typesetting Stick Cartridge Stamping Tool, issued to Bo on 15 Jul. 1986; and
- U.S. Pat. No. 5,299,896, Gun Jig, issued to Ferri on Apr. 5, 1994.

As illustrated by the background art, efforts are continuously being made in an attempt to develop devices for stamping or otherwise inscribing marks upon gun barrels and various other components of firearms. No prior effort, however, provides the benefits attendant with the present invention.

As such, it may be appreciated that there is a continuing need for a new and improved gun barrel stamper that impresses or otherwise creates a series of various alpha-numeric characters upon the exterior surface of a gun barrel in an even sequence and straight line so that a readable, identifying mark is created upon the exterior surface of the gun barrel. In these respects, the present version of the invention substantially departs from the conventional concepts and designs of the prior art and, in so doing, provides an apparatus that substantially fulfills this need. Additionally, the prior patents and commercial techniques do not suggest the present inventive combination of component elements arranged and configured as disclosed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY

The present version of the invention, which will be described in greater detail hereinafter, relates to the field of firearms accessories. More specifically, this version of the invention is concerned with gun barrel stamper for impressing upon a gun barrel a series of identifying alpha-numeric characters in an even sequence and straight line. My version of the invention overcomes all of the shortcomings listed previously, in addition to novel aspects that will be described in detail hereinafter.

Described briefly, according to a typical embodiment, the invention presents a gun barrel stamper that consists of a die container, a die ram, and a series of punch dies located within the die container against the die ram. The die container is comprised of a first longer sidewall, second, opposed longer sidewall, and shorter sidewall. An elongate aperture is located medially within each longer sidewall, and a circular aperture is located medially within the shorter sidewall. The sidewalls of the die container enclose an interior space.

A first bar is attached to the first longer sidewall between the elongate aperture located within the first longer sidewall and shorter sidewall and extends therefrom for some distance. A second bar is attached to the second longer sidewall between the elongate aperture located within the second longer sidewall and shorter sidewall and extends therefrom for some distance. Cylindrical bores extend completely through the first and second bars.

The die ram is comprised of a first shorter sidewall, second, opposed shorter sidewall, first longer sidewall, and second, opposed longer sidewall. An elongate aperture is located medially within the die ram. A first rectangular bar is located on the first longer sidewall between the elongate aperture and second shorter sidewall and extends therefrom for some distance. A second rectangular bar is located on the second longer sidewall between the elongate aperture and the second shorter sidewall and extends therefrom for some distance. A cylindrical bore extends completely through each bar.

Two threaded fasteners are inserted within the elongate apertures of the die container and die ram. A threaded fastener is inserted within the circular aperture of the shorter sidewall of said die container. A first U-shaped fastener with opposed threaded ends is releasably attached to the first and second bars of the die container. The threaded ends of the first U-shaped fastener occupy the cylindrical bores of said first and second bars. Cooperating threaded fasteners are attached to the threaded ends of the first U-shaped fastener.

A second U-shaped fastener with opposed threaded ends is releasably attached to the first and second bars of the die ram. The threaded ends of the second U-shaped fastener occupy the cylindrical bores of said first and second bars. Cooperating threaded fasteners are attached to the threaded ends of the second U-shaped fastener.

Punch dies are located within the interior space of the die container and are locked in place when the die ram is inserted into the die container. The first shorter sidewall of the die ram makes contact with and urges against the punch die located adjacent to the first shorter sidewall of the die ram. The threaded fastener located with the circular aperture of the shorter sidewall of the die container is rotated until it makes frictional contact with and urges against the punch die located at the second, opposed end of the series of punch dies. Threaded fasteners are inserted into the aligned, elongate apertures of the die container and die ram to attach the die container and die ram to each other and to lock the punch dies in position within the interior space of the die container.

To impress a series of alpha-numeric characters upon the exterior surface of a gun barrel, a portion of the gun barrel is located within the U-shaped fasteners, and the U-shaped fasteners are then releasably attached to the die container and die ram as previously described. A series of punch dies the desired alpha-numeric characters is disposed within the interior space of the die container as referenced previously. The ends of the punch dies with the alpha-numeric characters extend slightly beyond adjacent sidewalls of the die container.

The cooperating threaded fasteners located upon the threaded ends of the U-shaped fasteners are rotated to attach the die container and die ram and threaded fasteners to the gun barrel. The cooperating threaded fasteners are further rotated to urge the ends of the punch dies with the alpha-numeric characters against the exterior surface of the gun barrel with force or pressure sufficient to impress upon or otherwise create the same numeric-numeric characters upon the exterior surface of the gun barrel in an even sequence or straight line.

As needed, the number of punch dies located within the interior space of the die container can be increased or reduced as necessary and locked in place within the die container by relocating the die ram within the die container so as to impress upon the exterior surface of the gun barrel the desired sequence of alpha-numeric characters.

An elongate spacer can be fitted over the threaded ends of one of the U-shaped fasteners when the gun barrel stamper is being used with a gun barrel that tapers or slopes. The spacer maintains the die container and die ram with punch dies locked in place therein in approximate parallel relation to the longitudinal axis of the gun barrel. As such, the punch dies impart or otherwise create a clean, even impression of alpha-numeric characters when the die container and die ram with punch dies locked in place therein are urged against the gun barrel as described previously. The stamper may also include a die spacer adjustment mechanism that adjusts the die space to accommodate punch dies having non-standard widths.

My invention, therefore, resides not in any one of these features per se, but rather in the particular combination of all of them herein disclosed. It is distinguished from the prior art in this particular combination of all of its structures for the functions specified.

In order that the detailed description of the invention may be better understood and that the present contribution to the art can be more fully appreciated, additional features of the invention will be described hereinafter. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application nor is it intended to be limiting as to the scope of the invention in any way.

Accordingly, it is an object of my version of the invention to provide a low-cost, easy-to-manufacture, and easy-to-market gun barrel stamper.

A further object of my version of the invention is to provide an easy-to-use and versatile gun barrel stamper.

A significant object of the invention is to provide a gun barrel stamper that is comprised of a die container with interior space, a die ram inserted into the interior space of the die container, a series of punch dies located within said interior space, threaded fasteners for attaching the die container and die ram to each other and locking the punch dies in position within the interior space of the die container, and threaded fasteners for releasably attaching the die container and die ram to the exterior surface of a gun barrel so as to exert the punch dies locked in glace within the die container with force or pressure sufficient against the exterior surface of the gun barrel to impress alpha-numeric characters upon the exterior surface of said gun barrel.

A final but very significant object of the invention is to provide a gun barrel stamper that can impress upon the exterior surface of a gun barrel a series of alpha-numeric characters in an even sequence and straight line and can accommodate punch dies that are not of standard width.

For a better understanding of the invention, its operating advantages and the specific objects attained by its uses, reference should be made to the accompanying drawings and descriptive matter in which there is illustrated a preferred embodiment of the invention. The foregoing has outlined some of the more pertinent objects of the invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention illustrated by the accompanying drawings.

BRIEF DESCRIPTION OF THE DRAWINGS

The foregoing and other objects, features and advantages of the invention will become more fully understood from the following description of the preferred embodiment of the invention as illustrated in the accompanying drawings in which like reference characters refer to the same parts throughout different views. The drawings are not necessarily to scale, emphasis instead being placed upon illustrating the principles of the invention.

DRAWING REFERENCE NUMERALS

| | |
|---|---|
| 10 | Gun Barrel Stamper |
| 12 | Die Container |
| 14 | First Longer Sidewall |
| 16 | Second Longer Sidewall |
| 18 | Shorter Sidewall |
| 20 | Aperture |

-continued

| | |
|---|---|
| 22 | Aperture |
| 24 | Interior Space |
| 26 | Bar |
| 28 | Bar |
| 30 | Bore |
| 32 | Fastener |
| 34 | Spacer |
| 36 | Fastener |
| 38 | Fastener |
| 40 | Fastener |
| 42 | End |
| 44 | Fastener |
| 46 | Die |
| 48 | Die |
| 50 | Die |
| 52 | Die |
| 54 | Die |
| 56 | Die |
| 58 | Die Ram |
| 60 | First Shorter Sidewall |
| 62 | Second Shorter Sidewall |
| 64 | First Longer Sidewall |
| 66 | Second Longer Sidewall |
| 68 | Aperture |
| 70 | Bar |
| 72 | Bar |
| 74 | Bore |
| 76 | Fastener |
| 78 | End |
| 80 | Fastener |
| 82 | Gun Barrel |
| 84 | Spacer |
| 86 | Aperture |
| 90 | Die Space Adjustment Mechanism |
| 92 | Side Block |
| 94 | Access Hole |
| 96 | Set Screw |
| 98 | Fastener |
| 100 | End Block |

DESCRIPTION OF THE PREFERRED EMBODIMENT DESCRIPTION

Figure 1:
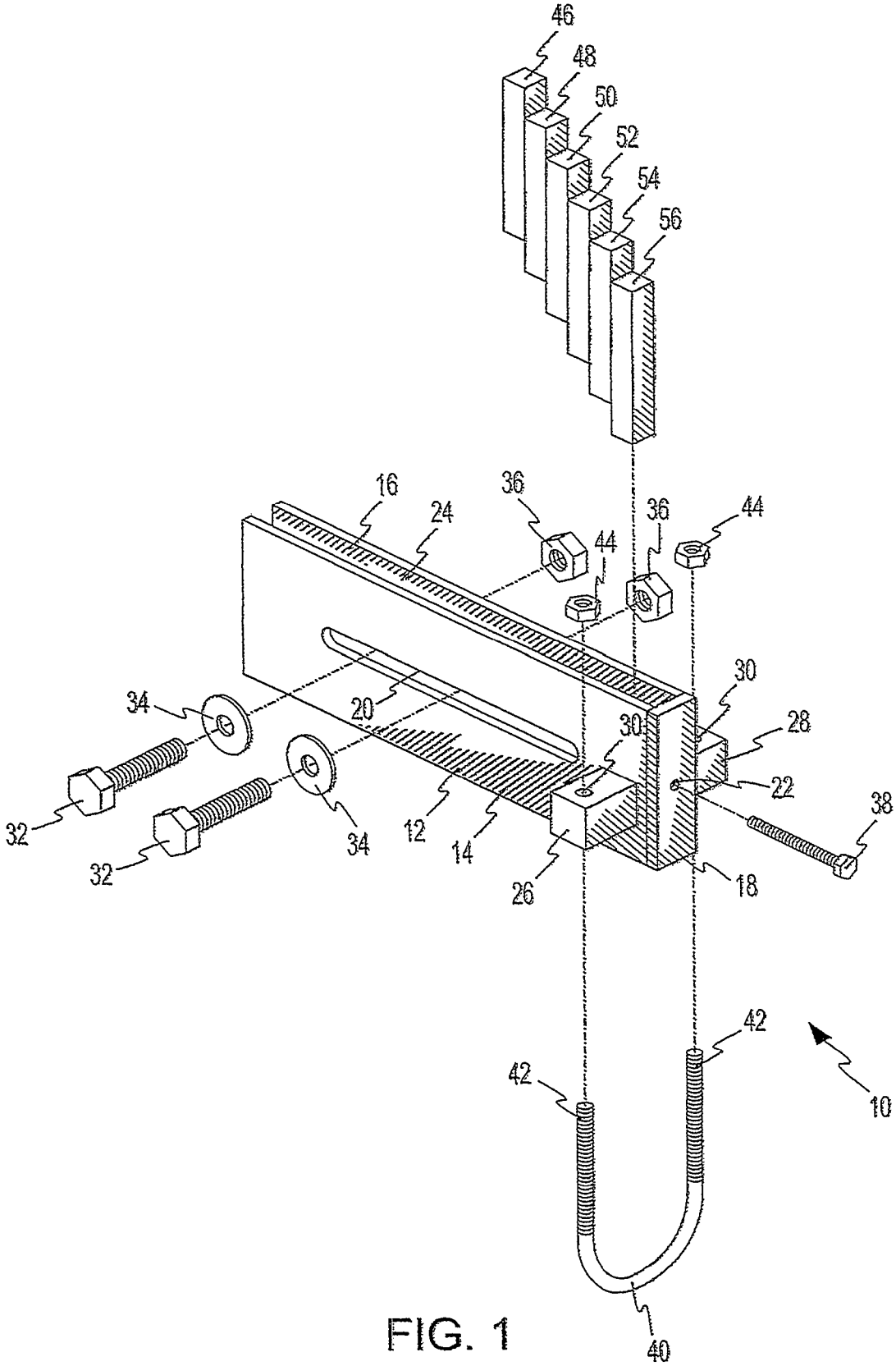
FIG. 1 is an exploded, perspective view of the die container of a gun barrel stamper.
Figure 2:
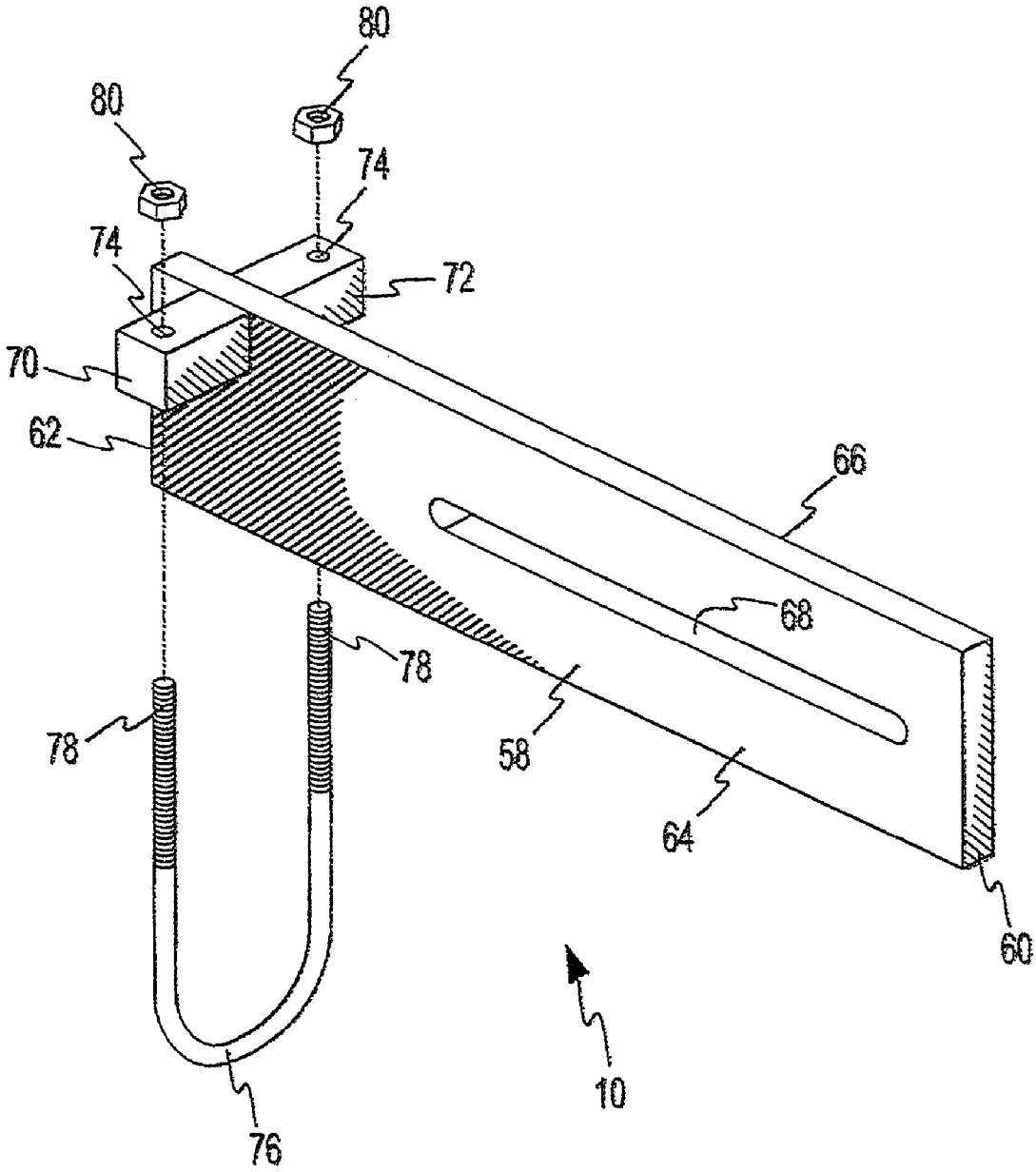
FIG. 2 is an exploded, perspective view of the die ram of a gun barrel stamper.
Figure 3:
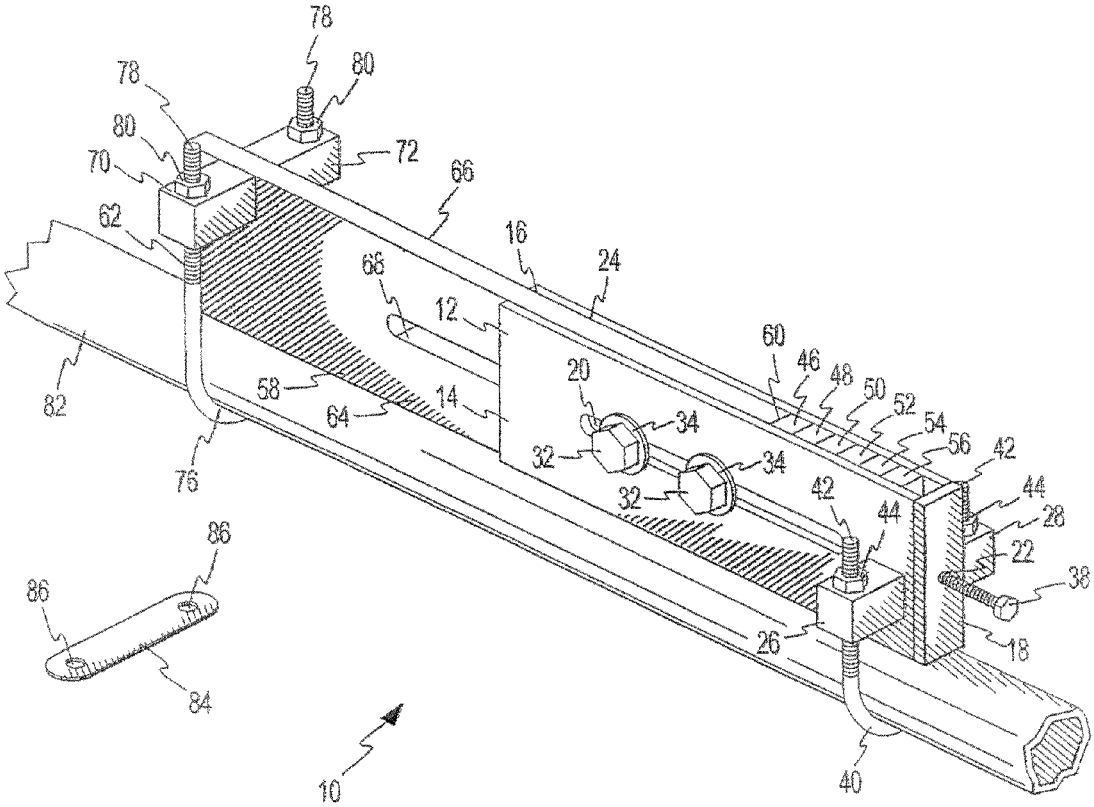
FIG. 3 is a perspective view of the gun barrel stamper attached to a gun barrel.
Figure 4:
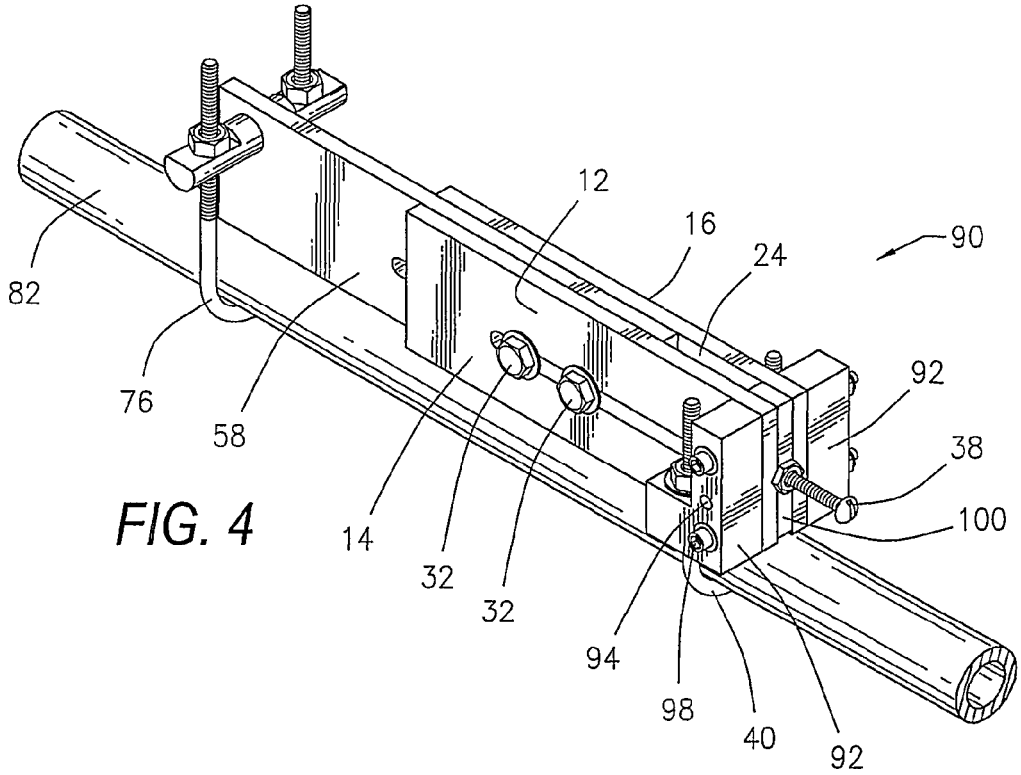
FIG. 4 is a perspective view of another embodiment of the gun barrel stamper that includes a die space adjustment mechanism.
Figure 5:
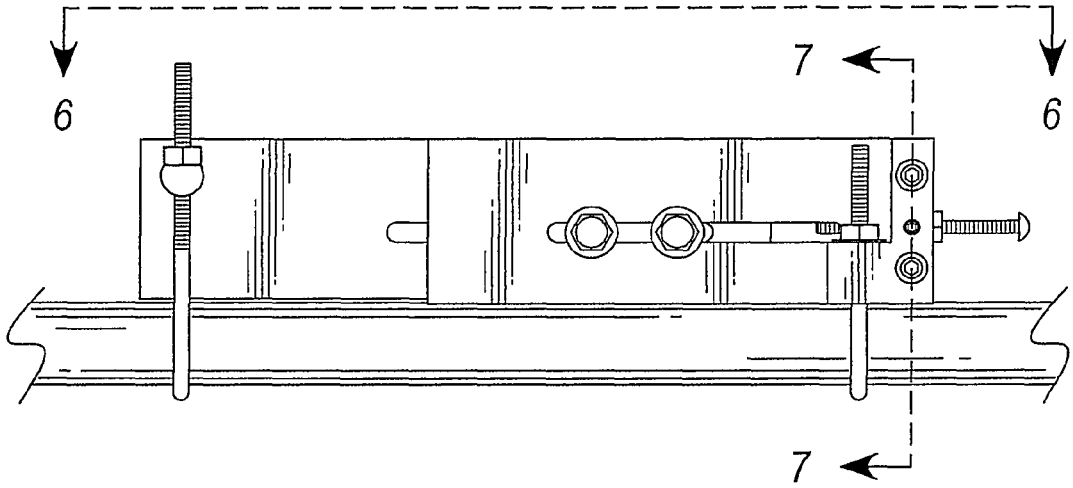
FIG. 5 is a side view of the gun barrel stamper with the adjustment mechanism.
Figure 6A:
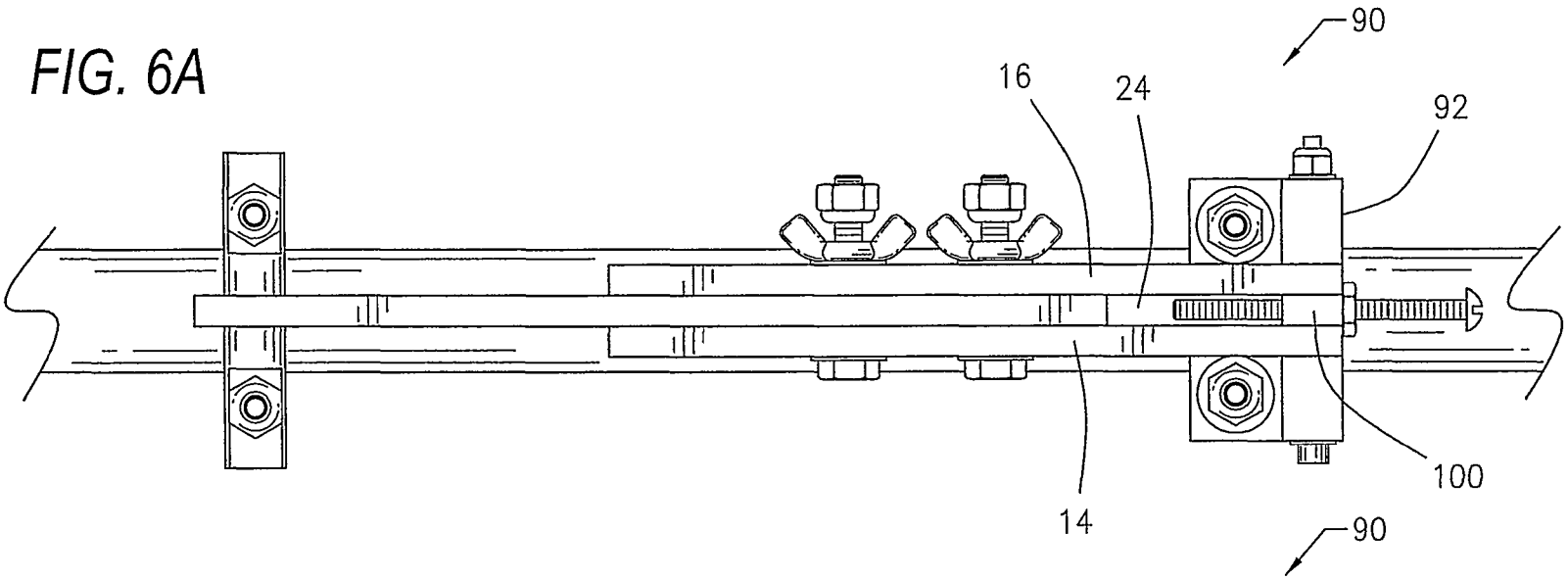
FIGS. 6A and 6B are a top view of the gun barrel stamper illustrated in FIG. 5 illustrating the die space in a closed and expanded state, respectively.
Figure 6B:
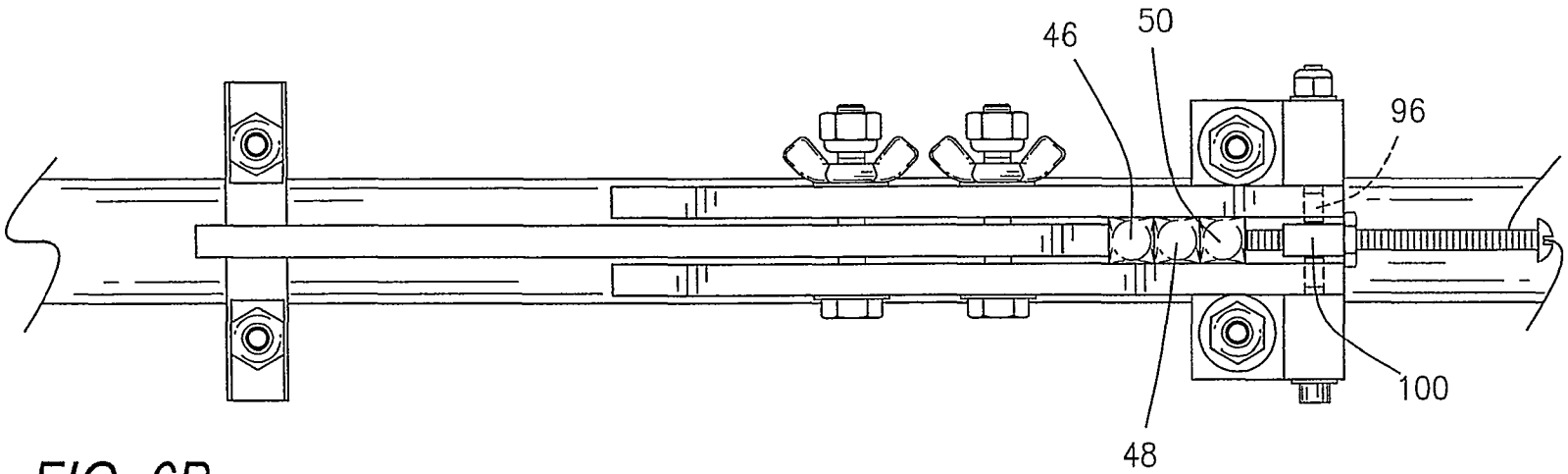
Figure 7A:
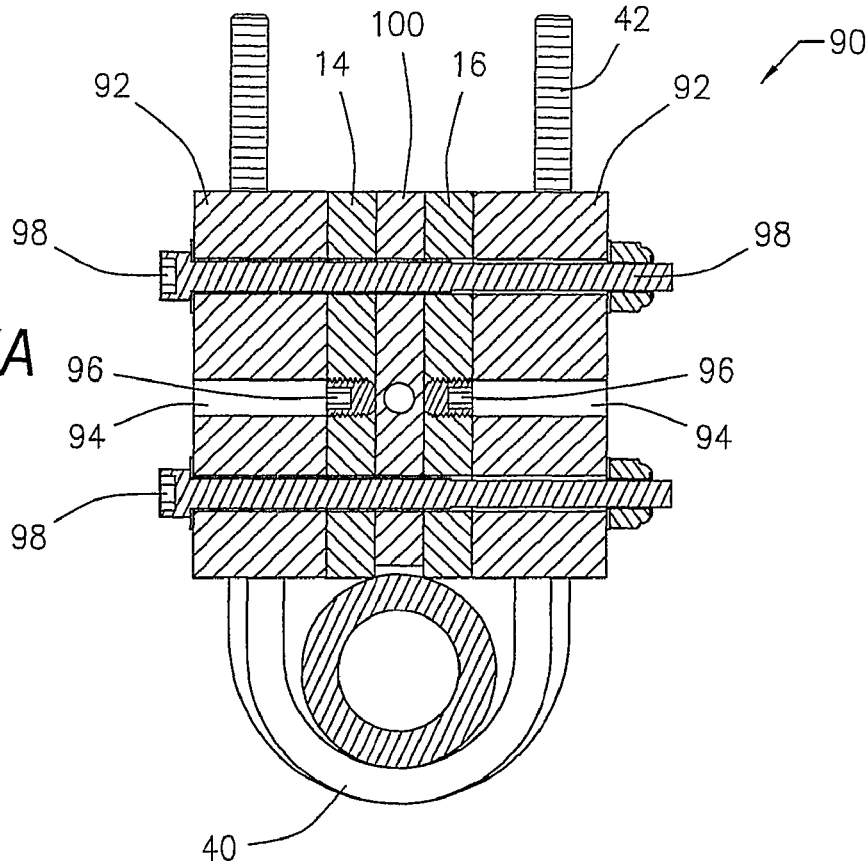
FIGS. 7A and 7B are a view of the gun barrel stamper taken along section line 7-7 of FIGS. 6A and 6B, respectively.
Figure 7B:
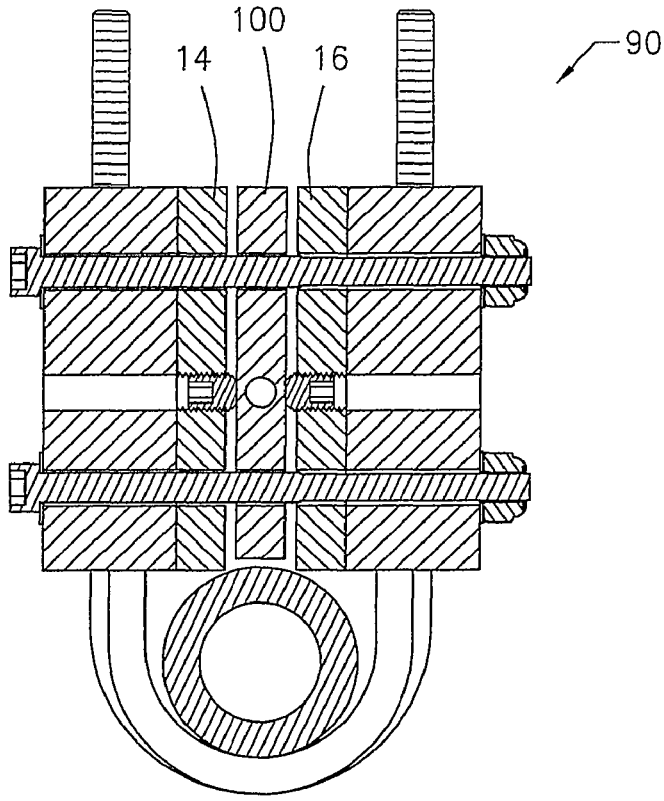

Referring now to the drawings and, in particular, to FIG. 1 to FIG. 3 wherein there are illustrated a typical embodiment of the gun barrel stamper 10. In FIG. 1, the present version of the invention 10 consists in part of a die container 12 having a first longer sidewall 14, a second, opposed longer sidewall 16, and a shorter sidewall 18. An elongate aperture 20 is located medially within each longer sidewall 14, 16, and a circular aperture 22 is located medially within the shorter sidewall 18. The sidewalls 14, 16, 18 enclose an interior space 24.

A first rectangular bar 26 is located on the first longer sidewall 14 between the elongate aperture 20 and the shorter sidewall 18 and extends therefrom for some distance. A second rectangular bar 28 is located on the second longer sidewall 16 between the elongate aperture 20 and the shorter sidewall 18 and extends therefrom for some distance. A cylindrical bore 30 extends completely through each bar 26, 28.

Referring again to FIG. 1, first and second threaded fasteners 32 are aligned for insertion through cooperating spacers 34 and through the elongate apertures 20 of the first 14 and second 16 longer sidewalls. The first and second threaded fasteners 32 are mated with cooperating threaded fasteners 36 to secure said fasteners 32 to the longer sidewalls 14, 16 within the apertures 20 thereof. A threaded fastener 38 is aligned for insertion into the aperture 22 of the second shorter sidewall 18.

A U-shaped fastener 40 having two threaded ends 42 is aligned for insertion of said threaded ends 42 through the cylindrical bores 30 of the first 26 and second 28 rectangular bars. The threaded ends 42 of the first U-shaped fastener 40 are mated with cooperating threaded fasteners 44 to secure said U-shaped fastener 40 to the rectangular bars 26, 28.

A series of punch dies 46, 48, 50, 52, 54, 56 is aligned for insertion into the interior space 24 of the die container 12. The punch dies 46, 48, 50, 52, 54, 56 are of the type well known in prior art and design having at one end thereof a raised impression or protuberance in the shape of an alpha-numeric character. The shape of the alpha-numeric character is transferred to a second, impressionable surface, such as a metallic surface, by pressing with considerable force or otherwise urging the end of one of the dies 46, 48, 50, 52, 54, 56 containing the shape of the alpha-numeric character against the second surface. In this manner, various sequences of alpha-numeric characters can be transferred to the second surface for identification, inventory control, security, and the like.

A die ram 58 is illustrated in FIG. 2. The die ram is flat and rectangular in shape comprised in part of a first shorter sidewall 60, second opposed shorter sidewall 62, first longer sidewall 64, and second opposed longer sidewall 66. An elongate aperture 68 is located medially within the die ram 58. A first rectangular bar 70 is located on the first longer sidewall 64 between the elongate aperture 68 and second shorter sidewall 62 and extends therefrom for some distance. A second rectangular bar 72 is located on the second longer sidewall 66 between the elongate aperture 68 and the second shorter sidewall 62 and extends therefrom for some distance. A cylindrical bore 74 extends completely through each bar 70, 72.

A U-shaped fastener 76 having two threaded ends 78 is aligned for insertion of said threaded ends 78 through the cylindrical bores 74 of the rectangular bars 70, 72. The threaded ends 78 of the U-shaped fastener 76 are mated with cooperating threaded fasteners 80 to secure said U-shaped fastener 76 to the rectangular bars 70, 72.

The die container 12, die ram 58, and fasteners 32, 36, 38, 40, 44, 76, 80 are comprised of material that is rigid and durable, such as carbon steel, stainless steel, aluminum, various composite materials, and the like.

During use, the die ram 58 is inserted into the interior space 24 of the die container 12. An appropriate number of punch dies 46, 48, 50, 52, 54, 56 is then inserted into the interior space 24 of the die container 12 between the end of the threaded fastener 38 inserted through the aperture 22 of the shorter sidewall 18 of the die container 12 and the first shorter sidewall 60 of the die ram 58. The ends of the punch dies 46, 48, 50, 52, 54, 56 with the raised impression or protuberance in the shape of an alpha-numeric character are positioned to extend slightly beyond the bottom side edges of the sidewalls 14, 16, 18 of the die container 12 and bottom side edges of the sidewalls 60, 62, 64, 66 of the die ram 58.

Once the punch dies 46, 48, 50, 52, 54, 56 are positioned within the interior space 24 of the die container 12 as desired, the punch dies 46, 48, 50, 52, 54, 56 are locked in place by inserting the threaded fasteners 32 through the aligned apertures 20 of the die container 12 and aperture 68 of the die ram 58 so that the first shorter sidewall 60 of the die ram 58 makes contact with and urges against the punch die 46 closest to the first shorter sidewall 60 of the die ram 58. At this point, the cooperating threaded fastener 44 can be rotated upon the shaft of the threaded fastener 34 to lock the die container 12 and die ram 58 together in place. The threaded fastener 38 inserted within the aperture 22 of the shorter sidewall 18 of the die container 12 is then rotated until the end of the threaded fastener 38 makes contact with and impinges against the closest punch die 56. In this manner, the punch dies 46, 48, 50, 52, 54, 56 are locked in place within the interior space 24 of the die container 12 between the first shorter sidewall 60 of the die ram 58 and end of threaded fastener 38 located within the aperture 22 of the shorter sidewall 18 of the die container 12.

Referring to FIG. 3, therein illustrated is the gun barrel stamper 10 releasably attached to the exterior surface of a portion of a gun barrel 82. The die container 12 and die ram 58 are affixed to each other with dies 46, 48, 50, 52, 54, 56 contained therein as described previously. The gun barrel 82 is located between the die container 12, die ram 58, and the U-shaped fasteners 40, 76. The U-shaped fasteners 40, 76 are secured to respective bars 26, 28, 70, 72 with cooperating threaded fasteners 44, 80, respectively, as described previously. The punch dies 46, 48, 50, 52, 54, 56 are located within the interior space 24 of the die container 12 and locked in place as referenced previously. With the punch dies 46, 48, 50, 52, 54, 56 positioned with the die container 12 as such, the threaded fasteners 44, 80 located on respective ends 42, 78 of the U-shaped fasteners 40, 76 are rotated until the ends of the punch dies 46, 48, 50, 52, 54, 56 extending beyond the bottom side edges of the sidewalls 14, 16, 18 of the die container 12 and bottom side edges of the sidewalls 60, 62, 64, 66 of the die ram 58 impinge against the exterior surface of the gun barrel 82 with force or pressure sufficient to impress the alpha-numeric characters located on the ends of the punch dies 46, 48, 50, 52, 54, 56 upon the exterior surface of the gun barrel 82. In this manner, a series of identifying alpha-numeric characters is impressed or otherwise created upon the surface of the gun barrel 82 in an even sequence and straight line.

As needed, the number of punch dies 46, 48, 50, 52, 54, 56 located within the interior space 24 of the die container 12 can be increased or reduced as necessary and locked in place within the die container 12 by relocating the first shorter sidewall 60 of the die ram 58 within the interior space 24 of the die container 12 so as to impress upon the exterior surface of the gun barrel 82 the desired sequence of alpha-numeric characters.

An elongate spacer 84 with apertures 86 at opposed ends thereof is provided for stamping alpha-numeric characters upon the exterior surface of a tapering gun barrel. Depending upon the slope or angle of the tapering gun barrel, the spacer 84 is secured to one of the U-shaped fasteners 40. 76 between the gun barrel and the bottom side edges of the sidewalls 14, 16, 18, of the die container 12 and bottom side edges of the sidewalls 60, 62, 64, 66 of the die ram 58.

The gun barrel is first located within the U-shaped fasteners 40, 76 and then the spacer 84 is placed over one of the U-shaped fasteners 40, 76, depending upon the slope of the gun barrel, by inserting the threaded ends 42, 78 of one of the U-shaped fasteners 40, 76, respectively, through the apertures 86 of the spacer 84. The U-shaped fasteners 40, 76 are then attached to the die container 12 and die ram 58 as described previously. In this manner, the spacer 84 maintains the die container 12 and die ram 58 with punch dies 46, 48, 50, 52, 54 locked in place therein in approximate parallel relation to the longitudinal axis of the gun barrel so as to ensure that the punch dies 46, 48, 50, 52, 54 create a clean, even impression of alpha-numeric characters when the die container 12, die ram 58, and punch dies 46, 48, 50, 52, 54 locked in place therein are pressed against the gun barrel as described previously.

Referring to FIGS. 4 to 7B, gun barrel stamper 10 may include a die space adjustment mechanism 90. In some cases, punch dies 46 to 54 are held to tight manufacturing tolerances and are, therefore, difficult if not impossible to insert into a fixed interior space 24. Adjustment mechanism 90 provides for an adjustable interior space 24 of die container 12. Adjustment mechanism 90 includes two L-shaped side blocks 92 that receive fastener 40 and an end block 100 that receives fastener 38. End block 100 replaces shorter sidewall 18 (see e.g. FIG. 1). Each side block 92 is connected to one of the first and second longer sidewalls 14, 16 of die container 12 by way of two fasteners 98. Fasteners 98 also secure end block 100 in proper alignment with side blocks 92 and the ends of longer sidewalls 14 and 16. Each side block 92 includes an access hole 94 that provides access to a set screw 96. Loosening fasteners 32 and 98, and then tightening set screws 96, forces sidewalls 14 and 16 to move opposite one another, thereby widening interior space 24. Once the appropriate spacing has been provided, punch dies 46, 48 and 50, fasteners 32 and 98 are tightened.

While this version of the invention has been illustrated and described in detail in the drawings and foregoing description, the same is to be considered as illustrative and not restrictive in character, it being understood that only the preferred embodiment has been shown and described and that all changes and modifications that come within the spirit of the version of the invention are desired to be protected. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

CONCLUSION AND SCOPE OF INVENTION

From the foregoing, it will be understood by persons skilled in the art that an improved gun barrel stamper has been provided. The invention is relatively simple and easy to manufacture, yet affords a variety of uses. While my description contains many specificities, these should not be construed as limitations on the scope of the version of the invention, but rather as an exemplification of the preferred embodiment thereof. The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention. Although this invention has been described in its preferred form with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A gun barrel stamping tool comprising a die ram including a first gun barrel fastener;

a die container including a second gun barrel fastener; and at least one die ram to die container fastener;

the die container receiving the die ram so that when at least one punch die is located in an interior space of the die container, the at least one punch die is temporarily secured between an end wall of the die ram and an opposing end wall of the die container;

the die ram and the die container each including an elongate aperture located medially within sidewall.

2. A gun barrel stamping tool according to claim 1 further comprising the at least one die ram to die container fastener being received by the elongate aperture of the die ram and of the die container, respectively.

3. A gun barrel stamping tool according to claim 1 further comprising a portion of a longer sidewall of the die ram extending past an end of a longer sidewall of the die container when the gun barrel stamping tool is fastened to a gun barrel.

4. A gun barrel stamping tool according to claim 1 further comprising the die container including a circular aperture located medially within a shorter sidewall of the die container.

5. A gun barrel stamping tool according to claim 4 further comprising a punch die fastener received by the circular aperture.

6. A gun barrel stamping tool according to claim 1, the first gun barrel fastener is located toward an end of the die ram.

7. A gun barrel stamping tool according to claim 1, the second gun barrel fastener is located toward an end of the die container.

8. A gun barrel stamping tool according to claim 1 further comprising the first and second gun barrel fasteners being located at opposite ends of the gun barrel stamping tool.

9. A gun barrel stamping tool according to claim 1, the first and second gun barrel fasteners are each a U-shaped fastener.

10. A stamping tool according to claim 1 further comprising at least one of the first and second fasteners including an elongate spacer.

11. A stamping tool according to claim 1 further comprising the die container being an adjustable width die container.

* * * * *